United States Patent [19]

Cox

[11] 4,213,368

[45] Jul. 22, 1980

[54] SOUNDING BANJO AND HEAD THEREFOR

[76] Inventor: Mark S. Cox, Rte. 1 Box 61A, Hiwassee, Va. 24347

[21] Appl. No.: 971,316

[22] Filed: Dec. 20, 1978

[51] Int. Cl.[2] ..... G10D 1/10; G10D 3/02

[52] U.S. Cl. ..... 84/269

[58] Field of Search ..... 84/269–273, 84/291, 294, 296, 300, 308, 267

[56] References Cited

U.S. PATENT DOCUMENTS 554,967 2/1896 Wilkes ..... 84/271

*Primary Examiner*—Lawrence R. Franklin

*Attorney, Agent, or Firm*—Irons and Sears

[57] ABSTRACT

An improved banjo head is described which provides a deeper and more mellow sound to the banjo. The new head also allows for sound pick up and amplification from each string. The new banjo head comprises a thin flexible membrane having a hole positioned on the periphery of this membrane and a means to reinforce said hole.

4 Claims, 3 Drawing Figures

SOUNDING BANJO AND HEAD THEREFOR

BACKGROUND OF THE INVENTION

1. Field of the Invention

This invention relates to an improved sounding banjo having a deeper and more mellow tone wherein the improvement is achieved through the use of a new head. More specifically, the invention relates to a new banjo head having a hole positioned on the periphery of the head and means to reinforce the hole.

2. Description of the Prior Art

Prior art banjos generally consist of a drum and a tailpiece mounted on the side of the drum to which the strings of the banjo are attached. The drum includes an annular metal band having a head formed from a thin, flexible membrane which is stretched over the band and retained around it by a metal ring. The annular band of the drum includes a neck which is aligned with and located opposite from the tailpiece of the banjo. The strings of the banjo are attached to the neck of the drum at one end, and to the end of the tailpiece at the other end. A bridge is placed between the strings and the head membrane to convey the vibration of the strings to the membrane, thereby achieving the tonal qualities of the banjo.

The prior art has attempted to improve the sound qualities of a banjo by various methods. For example, U.S. Pat. No. 72,517 discloses an improved sounding banjo having a sounding board with a hole in the periphery of the sounding board and a parchment head spread over top of the sounding board. This patent, however, does not disclose the idea of utilizing a hole in the banjo head itself in order to increase the sound qualities of the banjo.

U.S. Pat. No. 1,185,980 discloses an improvement in guitars, violins, banjos and other string instruments in order to increase the resonance of the instrument and at the same time to render the tone sweet and mellow. This patent discloses a hole located under the strings in a wood front board with a parchment head spaced in back of this front board in order to transmit the sounds of the stringed instrument. This patent likewise does not disclose the use of a hole located on the periphery of a parchment head alone to improve the sound of a banjo.

U.S. Pat. No. 1,858,171 discloses an improved sounding banjo having a sounding board and a head made of spruce wood, said head containing a hole underneath the strings to improve the sound of the banjo. This patent also does not disclose the use of a hole in a parchment head to improve the sound of a banjo.

U.S. Pat. No. 1,424,296 describes a banjo having an improved tone quality which comprises a convex wood bowl over which is stretched a head having a hole in it positioned directly under the strings. While this patent describes a hole in an apparent membrane head, it also has a sounding board to give the improved sound qualities.

U.S. Pat. No. 555,636 discloses a banjo having a sounding board and a parchment head with a hole in the center of the head directly under the strings and reinforced by a suitable binding. The banjo is said to have most resonant, strong, deep, ringing and sweet tones.

U.S. Pat. No. 554,967 also discloses a banjo having a sounding board and a vellum head with one or more holes located under the strings and strengthened by a ring of celluloid glued to the head preferably before the hole is cut.

None of the previously discussed patents describe a banjo comprising only a membrane head having a hole in it, but rather they all describe a banjo comprising a membrane head having a hole in it in combination with a sounding board.

No prior art is known in which the modern banjo, i.e. a banjo with a membrane head and lacking a sounding board as previously described, has a hole in the membrane head.

It is an object of this invention to provide an improved sounding banjo in which the banjo does not have a sounding board and a head therefor.

Applicant has found that a banjo lacking a sounding board and having a hole in the membrane head located directly under the strings does not produce a very pleasant sound but results in a "tinny" sound.

Applicant has found that by placing the hole at the periphery of the head results in a pleasing sound quality and is particularly effective with microphone amplification. The present invention provides a major change in the banjo sound and resonance. It allows for a deeper and more mellow tone while at the same time allowing for sound pick up and amplification from each individual string.

SUMMARY OF THE INVENTION

The invention is an improved banjo head comprising a thin, flexible membrane having a hole on the periphery of said membrane and a means to reinforce said hole. The hole may have a diameter of ½ to 4 inches, preferably 1½ to 2 inches. The hole is preferably reinforced by gluing pieces of plastic onto the membrane around the edge of the hole. A banjo lacking a sounding board utilizing the improved head is also described in which the head is placed on the banjo such that the hole is located at approximately a 60° angle from the neck of the banjo and such that the hole is on the upper side of the banjo head when the banjo is played.

DETAILED DESCRIPTION OF THE INVENTION

Figure 1:
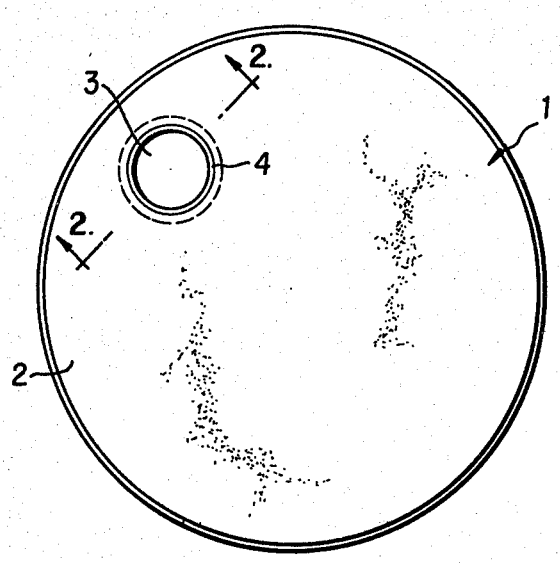
FIG. 1 shows a top view of the head of the banjo.

FIG. 1 illustrates the banjo head 1 comprising a thin, flexible membrane 2 with a hole 3 located on the periphery of the head. Plastic reinforcing means are indicated by numeral 4. The thin, flexible membrane 2 is of the standard type used on banjos today. The hole 3 may be any possible shape, for example, square, round, diamond or triangular, but it is preferably round. The size of the hole may range from ½ to 4 inches in diameter, preferably 1½ to 2 inches. The hole is reinforced by gluing plastic around it as described below so that the membrane does not tear as it is being placed on the banjo or during the life of the banjo head.

Figure 2:
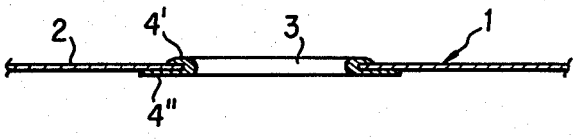
FIG. 2 illustrates a cut away section of the head as indicated by 2—2 in FIG. 1.

FIG. 2 illustrates the preferred means of reinforcing the hole 3 in membrane 2 by utilizing two separate pieces of plastic as indicated by 4' and 4". The piece of plastic 4' is in the shape of an "L" and is glued on the top of the membrane such that the base is glued to the edge of the hole and the remainder is glued parallel to the membrane surface. The second piece of plastic 4" is glued on the bottom of the membrane and parallel to it such that it abuts with 4'; 4' and 4'' together form a U-shaped reinforcing member.

The hole is preferably made by cutting the appropriate size hole in the thin, flexible membrane of a head. An example of a suitable head is one produced by Remo, Inc. and described in U.S. Pat. No. 2,934,989. The hole is then reinforced by gluing the plastic pieces onto the membrane as described above. After the glue is dry, the head may be placed on a banjo in the standard manner.

Figure 3:
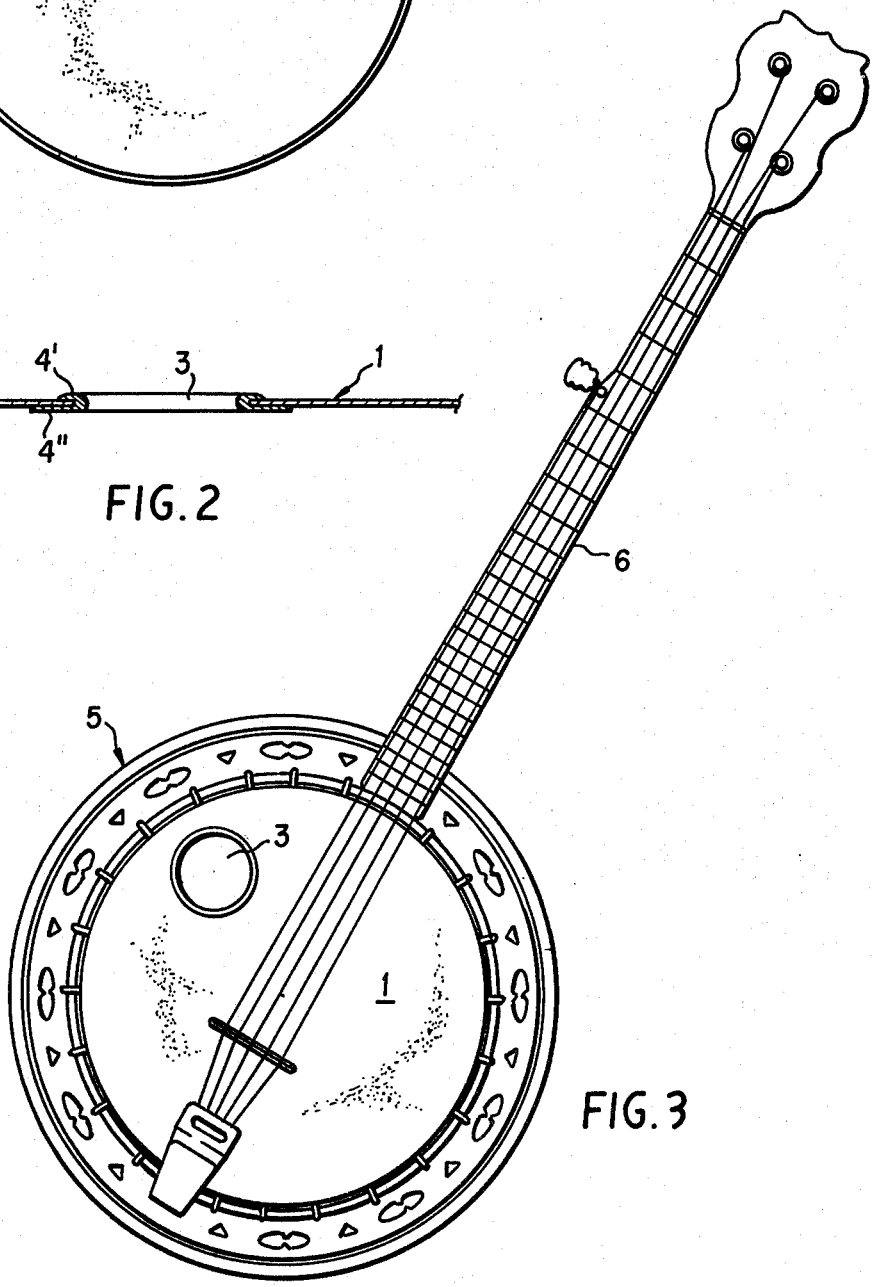
FIG. 3 illustrates a banjo with the head attached.

FIG. 3 illustrates a standard, modern banjo 5 which lacks a sounding board with the head of this invention attached. The hole 3 is positioned at approximately a 60° angle from the neck 6 and strings as measured from the center of the banjo head, that is, the center of the head is the apex of the angle formed by two lines, one extending in the direction of the strings and the other extending through hole 3, and on the upper side of the banjo head when the banjo is in playing position. Thus, the hole is in the upper left quadrant as shown in the drawing for a right-handed banjo, i.e. a banjo for a person who picks with his right hand. The hole should be in the upper right quadrant for a left-handed banjo.

Applicant has found that the variation in the size of the hole results in variation of the sound so that the sound of the banjo can be custom tailored to individual taste simply by increasing or decreasing the size of the hole. It has been found that by utilizing a hole on the upper side of the face of the banjo head produces a superior sound quality than if the hole were to be directly placed under the strings. This superior sound quality consists of a deeper and more mellow sound and for a better pick up and amplification of the individual strings. Without being committed to any theory on how the hole improves the sound of the banjo, it appears that the hole located at the periphery of the head provides a space or void under the strings such that the sound can be picked up and amplified by the hole in the same manner as a hole in a guitar picks up and amplifies the sound from the guitar strings.

It is understood that the invention is not to be limited to the embodiment set forth herein, but is to be limited only by the scope of the following claims.

What is claimed is:

1. An improved sounding banjo which comprises a drum, a tailpiece mounted on the side of said drum, a bridge and several strings having two ends, said drum comprising a thin, flexible membrane stretched over an annular band and retained in place by a metal rings, said membrane having a single hole therein and located on its periphery, said band having a neckpiece aligned with and located opposite said tailpiece, said strings attached to said neckpiece at one end and to said tailpiece at the other end, said strings forming a center line path across said head, said bridge placed between said strings and said membrance wherein the improvement comprises positioning said membrane such that said hole is at an approximately 60° angle from said center line path as measured substantially from the center of said head and near said neckpiece.

2. The improved sounding banjo of claim 1 wherein said hole has a diameter of ½ to 4 inches.

3. The improved sounding banjo of claim 1 wherein said hole has a diameter of 1½ to 2 inches.

4. The improved sounding banjo of claims 1, 2 or 3 wherein said hole is reinforced by gluing plastic onto said membrane around the edge of said hole.

* * * * *